US006147237A

United States Patent [19]

Zwanenburg et al.

[11] Patent Number: 6,147,237

[45] Date of Patent: Nov. 14, 2000

[54] MILD REFINING OF TRIGLYCERIDE OIL

[75] Inventors: Arend Zwanenburg; Marcho Stefanov Kouumdjiev, both of Vlaardingen, Netherlands; Jose Anibal Trujillo-Quijano, Campinos, Brazil

[73] Assignee: Lipton, Inc., Englewood Cliffs, N.J.

[21] Appl. No.: 08/952,692

[22] PCT Filed: May 29, 1996

[86] PCT No.: PCT/EP96/02295

§ 371 Date: Mar. 2, 1998

§ 102(e) Date: Mar. 2, 1998

[87] PCT Pub. No.: WO96/41852

PCT Pub. Date: Dec. 27, 1996

[30] Foreign Application Priority Data

Jun. 12, 1995 [EP] European Pat. Off. ..... 95201538

[51] Int. Cl.[7] ..... C11B 3/00

[52] U.S. Cl. ..... 554/204; 554/212; 426/541; 426/544; 426/545; 426/546

[58] Field of Search ..... 554/204, 212; 426/541, 544, 545, 546

[56] References Cited

FOREIGN PATENT DOCUMENTS

| | | | |
|---|---|---|---|
| 234 221 | 1/1987 | European Pat. Off. . | |
| 234221 | 9/1987 | European Pat. Off. ..... | C11B 3/10 |
| 63 093 348 | 7/1994 | Japan . | |
| 2 008 333 | 6/1986 | Russian Federation . | |
| 94/12596 | 6/1994 | WIPO ..... | C11B 3/00 |

OTHER PUBLICATIONS

J. Agric. FoodChem., 1994, 42, pp. 1054–1059.

Fette, Seiffen, Anstrichmitel, vol. 85, No. 12, 1993, pp. 479–483.

ISO 3960: 1998 (E), "Determination of peroxide value in animal and vegetable oils and fats", pp. 1–7–mentioned on p. 5 of the specification.

*Primary Examiner*—Deborah Carr

*Attorney, Agent, or Firm*—Gerard J. McGowan, Jr.

[57] ABSTRACT

Process for refining a triglyceride oil comprising stripping a triglyceride oil with an inert gas, characterized in that the refining process further comprises the preceding exposure of the triglyceride oil to an aqueous solution of ascorbic acid. Hydroperoxides are destroyed at a temperature <120° C. and within one hour.

11 Claims, No Drawings

MILD REFINING OF TRIGLYCERIDE OIL

This application is a 371 PCT/EP96/02295 filed May 29, 1996.

The present invention is concerned with a process for the refining of triglyceride oil under very mild conditions.

STATE OF THE ART

The purification process of a crude edible oil, particularly a triglyceride oil usually includes an initial removal of phospholipids (degumming), followed by the removal of substances which have a negative influence on taste, flavour and keepability. Those substances comprise inter alia free fatty acids, destabilising hydroperoxydes and, possibly, pesticides and polyaromatic hydrocarbons. Several unwanted substances may be removed by a process called deodorisation, which can be performed by gas stripping the oil with a stripping medium, usually steam or nitrogen, at temperatures above 200° C. and at reduced pressure. At such relatively high temperatures stripping may cause modification of the oil so that other unwanted compounds may be formed. A further disadavantage is that consumers may perceive high temperature gas stripping as a non-natural process, while natural processes are preferred for the preparation of foodstuffs and foodstuff ingredients.

PCT application WO 94/12596 (UNILEVER) provides a method for refining a triglyceride oil which comprises acidifying the oil and removing substances which separate from the oil, followed by a heat treatment, which consists of keeping the oil several hours at an elevated temperature (simmering) and stripping the oil at a temperature of 30–200° C. at reduced pressure. The compounds formed by oil oxidation will decompose during simmering and the volatile compounds formed are removed under reduced pressure conditions by the stripping gas. This method, because of the relatively mild conditions is referred to as mild refining and may be supported by a treatment with adsorbents.

Crude triglyceride oils contain hydroperoxides which are unstable substances resulting from oxidation of the oil. Unless a deodorization step removes this matter, off-flavour is readily formed during storage of the oil. The extent of oil oxidation and the content of hydroperoxides is expressed as a peroxide value (POV). The above prior art simmering process is carried out at a preferred temperature of 60–160° C. In order to lower the POV from about 10 to <1 the oil needs 15 hours of heating at 120° C. The process may proceed at still lower temperatures, temperatures which are perceived as relatively more natural, but a longer time would be required for obtaining a satisfactory result; 40–50 hours is common for temperatures below 100° C. A deodorizing process which proceeds quickly at such low temperatures would fullfil the need for enhanced natural oil processing.

SUMMARY OF THE INVENTION

It has now been found that the time as well as the temperature needed for decomposition of hydroperoxides in triglyceride oil can be reduced considerably when the gas stripping treatment is preceded by exposure of the triglyceride oil to an aqueous solution of ascorbic acid.

It has been found that even at exposure temperatures below 100° C. a satisfactory reduction of the POV is realised within several hours.

DETAILS OF THE INVENTION

The treatment of the triglyceride oil with ascorbic acid precedes stripping with an inert gas, preferably steam. It is important that the ascorbic acid is applied as an aqueous solution, which preferably contains about 20 wt. % of ascorbic acid and which suitably is dispersed into the oil. Vigorous stirring, using for example an effective stirring device such as the high speed Ultra-Turrax™, promotes a quick and complete reduction of POV, probably as an effect of the increased contact surface of the oil with the droplets of the ascorbic acid solution. The size of the droplets preferably is 0.1–100 $\mu$m. The dispersed aqueous phase has an ascorbic acid concentration being 5–65 wt. %, preferably 15–50 wt. %. Calculated on the oil the concentration of ascorbic acid preferably is 0.01–1.0 wt. %, more preferably 0.05–0.15 wt. %.

The effect of the peroxyde decomposition is greatly enhanced when the treatment with ascorbic acid is preceded by contacting the oil with a solution of phosphoric acid or citric acid. Preferably the oil is stirred a short time with a 50% citric acid solution. An exposure time of only 5–30 min, depending on effectivity of stirring, would suffice for reducing with at least 50% the time needed for subsequent ascorbic acid induced peroxide decomposition according to the present invention.

For the ascorbic acid induced peroxide decomposition a catalytic amount comprising at least 0.01 ppm of iron in a soluble form has to be present.

Stripping is carried out using the methods well known to the skilled man. An inert gas is used, such as steam or nitrogen. Preferably the traditional stripping temperatures higher than 200° C. are avoided. The stripping temperature preferably is <120° C., more preferably 70° C.–90° C. Stripping temperature may be lower, but at the expense of strongly increasing process times.

Generally it is advantageous that the oil before its 10 exposure to ascorbic acid has been subjected to a degumming treatment, preferably an acid degumming treatment, e.g. superdegumming, as described in U.S. Pat. No. 4,049,686, or unidegumming, as described in U.S. Pat. No. 5,286,886. These processes fit in an all-natural refining process of triglyceride oil. As an effect the contents of phosphorous and iron are reduced to P<10 ppm and Fe<0.25 ppm. The preceding removal of phospholipids is not necessary for carrying out the invention, when the stripping temperature does not exceed 120° C.

Optionally, the refining treatment includes a treatment with an adsorbent and/or a short path distillation for further purifying the triglyceride oil.

Before stripping, the oil is washed in order to remove remains of ascorbic acid and iron. The oil may be dried and filtered before it enters the stripping vessel.

The ascorbic acid treatment according to the invention is carried out preferably at a temperature not higher than 120° C. It is also effective when the exposure step proceeds at a temperature not higher than 90° C., but preferably it is higher than 60° C. Lower temperatures are possible too, but at the expense of increased processing times. Even at these relatively low temperatures the ascorbic acid exposure step and the subsequent stripping treatment each take not more than four to five hours. POV values close to zero may be easily attained, often already after 15 minutes exposure to aqueous ascorbic acid.

The present process is so mild that not only valuable natural anti-oxidants such as tocopherols stay in the oil. Also the natural flavour of the oil is preserved. Since for many vegetable oils this flavour is appreciated, the flavour preservation adds to the advantages of the process of the invention. By the absence of high temperatures and agressive chemicals the process qualifies as mild and natural.

The invention is further illustrated by the following examples:

GENERAL

POV Measurement

Before the measurement of POV a sample is washed three times by shaking under nitrogen with 50 vol. % of de-aerated demineralised water followed by heating at 60–70° C. The sample is finally dried by stripping with nitrogen for 10 minutes at the steam bath. The sample is cooled and stored under exclusion from atmospheric oxygen.

The POV measurement proceeds as an ordinary jodometric titration, which is common knowledge for the man skilled in the art and which is described in various reference papers such as e.g. ISO 3960, *"Determination of peroxide value in animal and vegetable oils and fats"*.

EXAMPLE 1

Mild Refining of Sunflower Oil

Two parts of cold-pressed sunflower oil were mixed with one part of extracted sunflower oil and the mixture was degummed using superdegumming and unidegumming. 1.0 wt. % of a (20%) ascorbic acid solution was added to and dispersed through 700 g of degummed oil, having a POV of 12.3. The mixture, containing 0.9 wt % of dissolved and dispersed water, was stirred in an ideally stirred mode at 1500 rpm at 90° C. for 130 minutes using a so-called turbine stirrer. The oil was then washed five times with 10 wt. % of water of 90° C., dried under reduced pressure (25 mbar) and filtered over a Seitz K-100 filter under nitrogen at 50° C. Finally the oil was stripped for 5 hours at 90° C. and at 2–3 mbar with 3 wt. % of steam per hour. The refined oil possessed a pleasant natural taste and remained free from off-taste for at least six months. The products of the various refining steps are characterized by values summarized in table I. The same process carried out without ascorbic acid does only show slight peroxide decomposition within 6 hours (table IA).

TABLE I

| Subsequent steps | P ppm | Fe ppm | Extinction (232/268) | POV | FFA % |
|---|---|---|---|---|---|
| Start: crude sunflower oil | 95 | 0.56 | 2.60/0.27 | 8.2 | 1.10 |
| after superdegumming | 22 | 0.16 | 2.60/0.28 | 11.1 | |
| after unidegumming | 4 | 0.08 | 2.61/0.31 | 12.3 | |
| after treatment with ascorbic acid | | | | 0.0 | |
| after water wash and stripping | 2 | 0.04 | 2.32/0.65 | 0.2 | 1.04 |

empty boxes: non-determined

TABLE IA

| Period of stirring (hours) no ascorbic acid present | POV |
|---|---|
| 0 | 8.2 |
| 1 | 8.1 |

TABLE IA-continued

| Period of stirring (hours) no ascorbic acid present | POV |
|---|---|
| 2 | 7.9 |
| 4 | 7.0 |
| 6 | 7.0 |

EXAMPLE 2

Mild Refining of Sunflower Oil 1.5 wt. % of a (20%) ascorbic acid solution was added to 200 g of superdegummed and unidegummed sunflower oil. The mixture containing 1.2 wt % of dissolved and dispersed water, was stirred using an Ultra-Turrax™ at 13,500 rpm at 90° C. for 15 min. The oil was then washed three times with 10% of water of 90° C. and dried under reduced pressure (25 mbar). Finally the oil was stripped for 5 hours at 90° C. and at 2–3 mbar with 3 wt. % of steam per hour. The oil showed no off-taste and remained free from off-taste for at least six months. The oil before and after ascorbic acid treatment is characterized by values summarized in Table II.

TABLE II

| Subsequent steps | Extinction (232/268) | POV | FFA % |
|---|---|---|---|
| Start: superdegummed sunflower oil | 2.60/0.28 | 11.1 | 1.10 |
| After treatment with ascorbic acid | 2.82/0.57 | 0.0 | 1.08 |

EXAMPLE 3

Mild Refining of Sunflower Oil

To 700 g of crude sunflower oil (P content: 95 ppm) 0.5 wt. % of a (20%) ascorbic acid solution was added and stirred, in a so-called ideally stirred mode, at 90° C. and at 1500 rpm. The total water content (dissolved and dispersed) of the oil was 0.5 wt. %. For reduction of the POV to values below 1.0 240 minutes exposure time were necessary. The oil was then washed three times with 5 wt. % of water of 90° C., dried under reduced pressure (25 mbar) and filtered. The POV was decreased to 0.4. Finally the oil was stripped for 5 hours with 3 wt. % of steam per hour at 120° C. and at 3 mbar. The refined oil possessed a reasonably bland taste and remained free from off-taste for at least six months. The oil, before and after ascorbic acid treatment, is characterized by values summarized in Table III.

TABLE III

| Subsequent steps | Extinction (232/268) | POV | FFA % |
|---|---|---|---|
| Crude sunf lower oil | 2.58/0.28 | 8.1 | 1.05 |
| After treatment with ascorbic acid | 2.55/0.41 | 0.4 | 1.02 |
| After treatment with ascorbic acid and stripping | 2.50/0.46 | 0.1 | 0.97 |

COMPARISON EXAMPLE 3A

Mild Refining of Sunflower Oil 0.5 wt. % of a (20%) citric acid solution was added to 700 g of crude sunflower oil (P content: 95 ppm) and stirred at 90° C. for 30 min at 1500 rpm. The total water content (dissolved and dispersed) of the oil was 0.5 wt. %. The oil was then washed three times with 5 wt. % of water of 90° C. and dried under reduced pressure (25 mbar). The POV was still 7.8. Finally the oil was stripped for 5 hours with 3 wt. % of steam per hour at 120° C. and at 3 mbar. The refined oil possessed a reasonably bland taste, but developed strong off-flavour within 3 months. The oil, before and after citric acid treatment, is characterized by values summarized in Table IIIA.

TABLE IIIA

| Subsequent steps | Extinction (232/268) | POV | FFA % |
|---|---|---|---|
| Crude | 2.58/0.28 | 8.1 | 1.05 |
| Crude sunflower oil | 2.58/0.28 | 8.1 | 1.05 |
| After treatment with citric acid | | 7.8 | |
| After treatment with citric acid and stripping | | 4.1 | |

empty boxes: non-determined

EXAMPLE 4

Mild Refining of Sunflower Oil

Example 3 was repeated but before the addition of ascorbic acid solution 0.2 wt. % of a (50%) citric acid solution was admixed and stirred at 90° C. for 30 min at 1000 rpm. Already after 90 min of subsequent stirring with the ascorbic acid solution the POV has dropped to 0.3. Table IV shows the results of the combined treatment.

TABLE IV

| Subsequent steps | Ext. (232/268) | POV | FFA % |
|---|---|---|---|
| Crude sunflower oil | 2.58/0.28 | 8.1 | 1.05 |
| After treatment with citric acid | | 7.6 | |
| After treatment with ascorbic acid | | 0.3 | |
| After stripping | 2.46/0.52 | 0.1 | 1.06 |

empty boxes: non-determined

An unexpected synergistic effect occurs which enormously speeds up the peroxide decomposition.

We claim:

1. Process for refining a triglyceride oil which contains >0.01 ppm of iron in a soluble form comprising stripping a triglyceride oil with an inert gas and, preceding the stripping, the exposure of the triglyceride oil to an aqueous solution of ascorbic acid.

2. Process according to claim 1, where the ascorbic acid solution has been dispersed in the oil and consists of droplets having a size of 0.1–100 $\mu$m.

3. Process according to claim 1, where the dispersed ascorbic acid solution contains 15–50 wt. % of ascorbic acid.

4. Process according to claim 1, where the oil contains 0.01–1 wt. % of ascorbic acid.

5. Process according to claim 1, where the oil before its exposure to ascorbic acid has been subjected to a degumming treatment.

6. Process according to claim 1, where the oil before its exposure to ascorbic acid has been subjected to a treatment with citric acid or phosphoric acid.

7. Process according to claim 1, where the exposure step proceeds at a temperature not higher than 120° C.

8. Process according to claim 1, where the stripping step proceeds at a temperature not higher than 120° C.

9. Process according to claim 1, where the refining treatment further includes a treatment with an adsorbent and/or a short path distillation.

10. Process according to claim 1, where the stripping temperature is 70° C.–90° C.

11. Foodstuffs in which an oil is incorporated which has been prepared with a process according to claim 1.

* * * * *